US005569148A

United States Patent [19]

LaFreniere et al.

[11] Patent Number: 5,569,148

[45] Date of Patent: Oct. 29, 1996

[54] METHOD AND APPARATUS FOR MANUFACTURING PALLET SPACERS

[75] Inventors: Brian R. LaFreniere, Lambertville, Mich.; Dick L. Cardwell, Holland, Ohio; George A. Spillson, Monroe, Mich.

[73] Assignee: Bay Corrugated Container, Inc., Monroe, Mich.

[21] Appl. No.: 180,222

[22] Filed: Jan. 12, 1994

Related U.S. Application Data

[63] Continuation-in-part of Ser. No. 980,533, Nov. 23, 1992, abandoned.

[51] Int. Cl.[6] ..... B65H 45/04

[52] U.S. Cl. ..... 493/462; 493/454; 493/964; 108/51.3

[58] Field of Search ..... 493/136, 137, 493/140, 139, 175, 454, 462, 964, 295; 108/51.3

[56] References Cited

U.S. PATENT DOCUMENTS

| | | | |
|---|---|---|---|
| 484,041 | 10/1892 | Murray | 493/175 |
| 1,747,367 | 2/1930 | Hohl | 493/462 |
| 2,016,052 | 1/1934 | Roeder | 164/91 |
| 2,432,295 | 12/1947 | Donahue | 108/51.3 |
| 2,493,562 | 1/1950 | Yarman | 108/51.3 |
| 2,691,500 | 2/1952 | Baumann | 248/120 |
| 2,732,063 | 1/1956 | Dedek | 493/462 |
| 2,970,797 | 3/1959 | Desbols | 248/120 |
| 3,196,759 | 7/1965 | Palmer | 493/139 |
| 3,199,670 | 8/1965 | Palmer . | |
| 3,772,969 | 11/1973 | Carter | 93/84 R |
| 4,090,433 | 5/1978 | Jardine et al. | 93/58.2 R |
| 4,106,398 | 8/1978 | Buisson | 93/84 TW |
| 4,551,127 | 11/1985 | Rich | 493/462 |
| 4,619,637 | 10/1986 | Jones . | |
| 4,622,026 | 11/1986 | Ito et al. . | |
| 4,638,745 | 1/1987 | Sheffer | 108/111 |
| 4,792,325 | 12/1988 | Schmidtke | 493/334 |
| 5,147,269 | 9/1992 | Jondelius . | |
| 5,205,807 | 4/1993 | Adams, Jr. et al. . | |
| 5,207,631 | 5/1993 | Schmidtke et al. | 493/334 |
| 5,222,444 | 6/1993 | Youell, Jr. et al. | 108/51.3 |

*Primary Examiner*—Jack W. Lavinder
*Attorney, Agent, or Firm*—Brooks & Kushman P.C.

[57] ABSTRACT

An apparatus for forming a pallet spacer from a one-piece blank, the one piece blank having at least a first end and a second end, a retention segment disposed between the first and second ends, the retention segment defining a retention aperture, the second end including a cut-out flange having a hinge, the apparatus comprising a base, a rotating mandrel assembly mounted on the base for wrapping the one-piece blank around itself such that the retention aperture is registered directly adjacent the cut-out flange, the rotating mandrel assembly including a selective engagement means for gripping the first end of the one-piece blank when the one-piece blank is wrapped around itself, a punch for pushing the cut-out flange into the retention aperture thereby retaining the one-piece blank in a coiled shape forming a pallet spacer and a stripper for removing the pallet spacer from the rotating mandrel assembly.

14 Claims, 5 Drawing Sheets

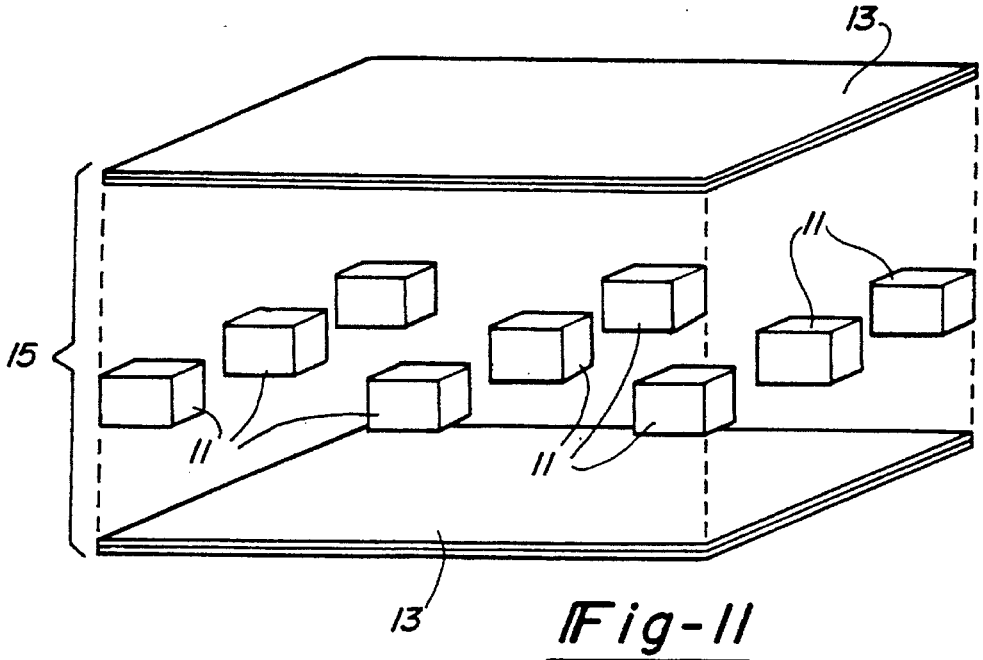
Fig-11
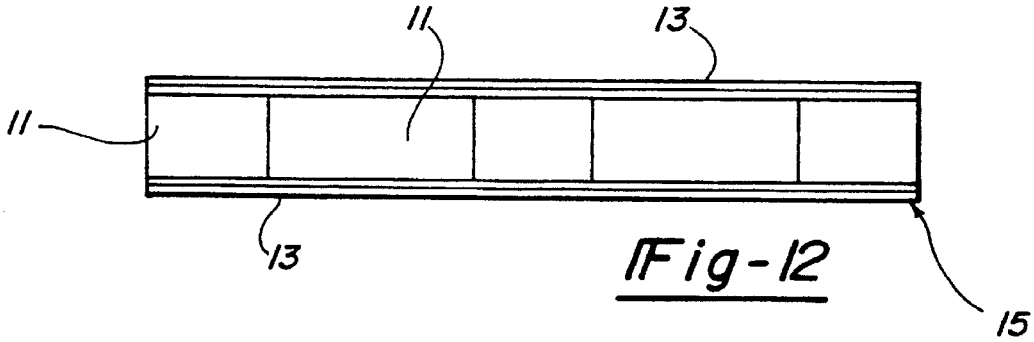
Fig-12
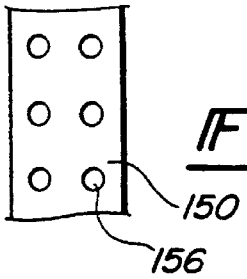
Fig-13
Fig-14
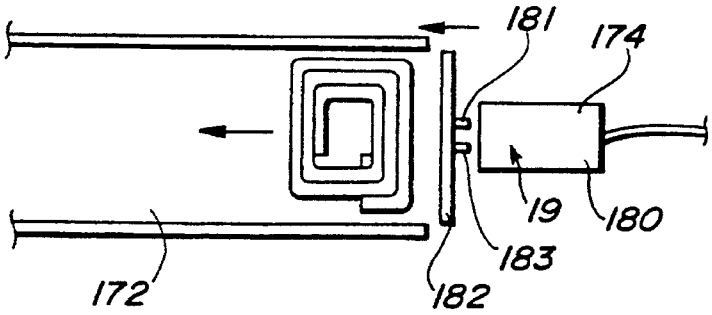

METHOD AND APPARATUS FOR MANUFACTURING PALLET SPACERS

This is a continuation-in-part application of Ser. No. 07/980,533, filed Nov. 23, 1992 and entitled "Recyclable Corrugated Cardboard Pallet and Method of Making A Corrugated Cardboard Pallet" now abandoned. This application is further related to application Ser. No. 08/118,399, filed Sep. 7, 1993 and entitled "Method and Apparatus for Manufacturing Corrugated Pallets", now U.S. Pat. No. 5,385,625.

TECHNICAL FIELD

This invention relates to an apparatus for manufacturing spacers for pallets, and more particularly to an apparatus and method for manufacturing corrugated cardboard pallet spacers.

BACKGROUND ART

Pallets are used to store and ship a wide variety of materials or products. Conventional pallets are most often fabricated from wood. One problem associated with wooden pallets is that they are a relatively high cost item. Wooden pallets are generally intended to be used more than once and, if damaged, must be repaired to make their use economically viable. Substantial costs are incurred in repairing wood pallets.

It has previously been proposed to include corrugated cardboard or other paper products in the manufacture of pallets. For example, in Yamaguchi et al U.S. Pat. No. 4,714,026 and Vilella U.S. Pat. No. 4,799,620, combination plastic and paperboard pallets are proposed. Clasen U.S. Pat. No. 5,076,176 discloses a cardboard pallet comprising cardboard sheets separated by a stacked, corrugated cardboard spacers.

Current manufacturing methods, directed at producing corrugated cardboard spacers for use with cardboard pallets, are entirely manual. Manual manufacture of spacers is slow and inefficient due to the relatively small size of the spacer and the attendant specialized manual manipulations required to produce such a pallet spacer. More specifically, the pallet spacers, of the coiled or spiral design, must be tightly wound around themselves to form the desired shape. This coiling or spiraling procedure is particularly difficult to manually perform on a consistent basis.

Further, a consistently shaped spiral pallet spacer is desired for even distribution of weight across the upper and lower surfaces of the pallet. Uneven weight distribution may cause early fatigue or failure of the corrugated cardboard pallet, causing an overall reduction in the useful, operational life of the cardboard pallet.

Applicant's invention is directed to solving the above problems by providing a fully automated apparatus which will reduce the cost associated with making corrugated cardboard pallet spacers and further provide high quality, consistently dimensioned spacers.

Important objects and advantages achieved by Applicant's invention are summarized below.

SUMMARY OF THE INVENTION

It is an object of the present invention to provide an apparatus for manufacturing a low cost corrugated cardboard pallet spacer.

It is another object of the present invention to provide an apparatus for manufacturing a cardboard pallet spacer which uses only a minimum amount of cardboard while producing a relatively strong, lightweight pallet spacer.

It is yet another object of the present invention to provide an apparatus for manufacturing a corrugated cardboard pallet spacer which produces consistently shaped pallet spacers quickly and economically.

A further object of the present invention is to provide an a fully automated apparatus for manufacturing a corrugated cardboard pallet spacer.

It is a more specific object of the invention to provide an apparatus for manufacturing a corrugated pallet spacer from a one-piece blank, the one piece blank having at least a first end and a second end, a retention segment disposed between the first and second ends, the retention segment defining a retention aperture, the second end including a cut-out flange having a hinge, the apparatus comprising a base, a rotating mandrel assembly mounted on the base for wrapping the one-piece blank around itself such that the retention aperture is registered directly adjacent the cut-out flange, the rotating mandrel assembly including a selective engagement means for gripping the first end of the one-piece blank when the one-piece blank is wrapped around itself, a punch for pushing the cut-out flange into the retention aperture thereby retaining the one-piece blank in a coiled shape forming a pallet spacer and a stripper for removing the pallet spacer from the rotating mandrel assembly.

According to another aspect of the present invention, a method of manufacturing a corrugated cardboard pallet spacer is provided. The method includes a) providing a one piece blank having at least a first end and a second end, a retention segment disposed between the first and second ends, the retention segment defining a retention aperture, the second end including a hinged flange, b) providing a rotatable mandrel shaped correspondingly to the a desired shape of the pallet spacer, c) wrapping the one-piece blank around itself such that the retention aperture is registered directly adjacent the flange, d) punching the flange into the retention aperture thereby retaining the one-piece blank in a coiled shape forming a pallet spacer, and e) ejecting the pallet spacer from the rotating mandrel assembly.

The above objects, features and advantages of the present invention, as well as others, are readily apparent from the foregoing detailed description of the invention in view of the drawings.

BRIEF DESCRIPTION OF THE DRAWINGS

FIG. 11 is a perspective view of a corrugated pallet having a plurality of pallet spacers made in accordance with the present invention;

FIG. 12 is a side view of a corrugated pallet having a plurality of pallet spacers made in accordance with the present invention;

FIG. 13 is a top view of the vacuum belt of the present invention looking along lines 13—13 of FIG. 3; and FIG. 14 is a top view of the spacer accumulator of the present invention.

BEST MODE FOR CARRYING OUT THE INVENTION

Figure 1:
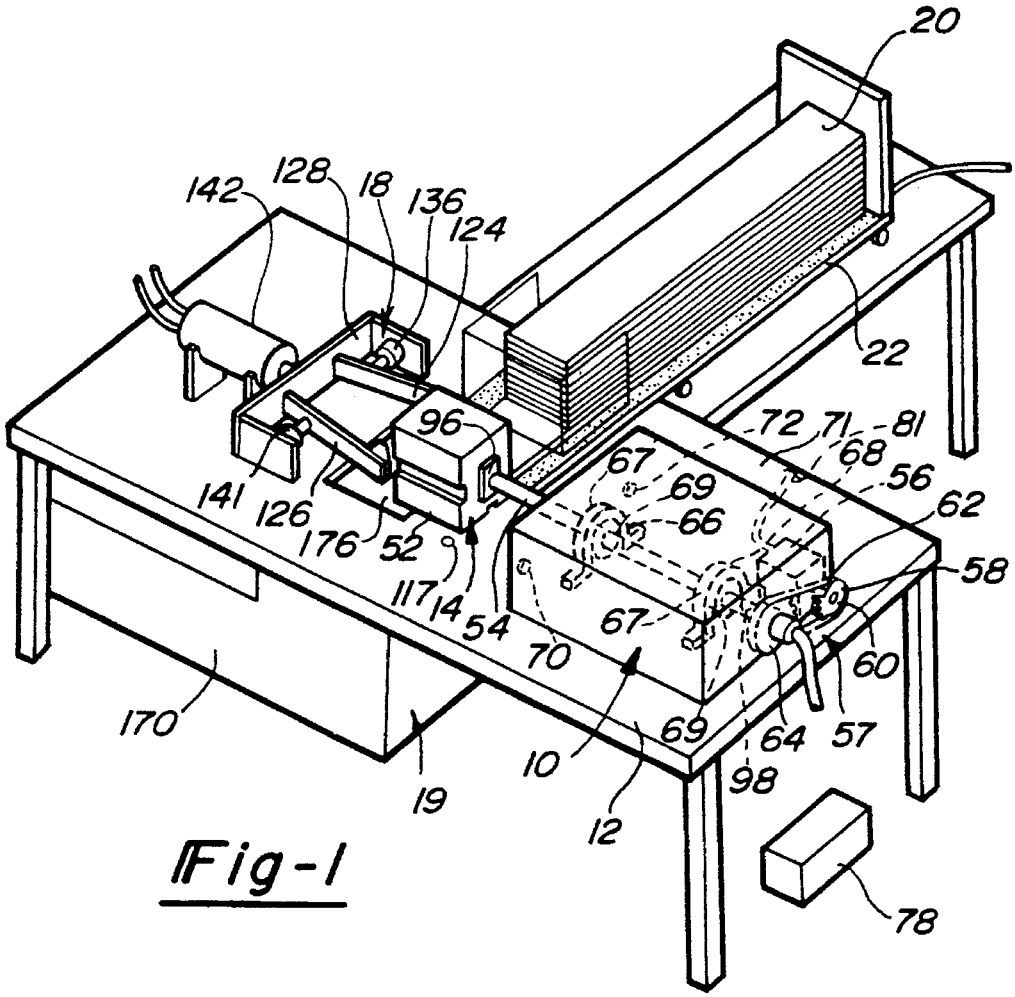
FIG. 1 is a perspective view of the pallet spacer manufacturing apparatus of the present invention.
Figure 2:
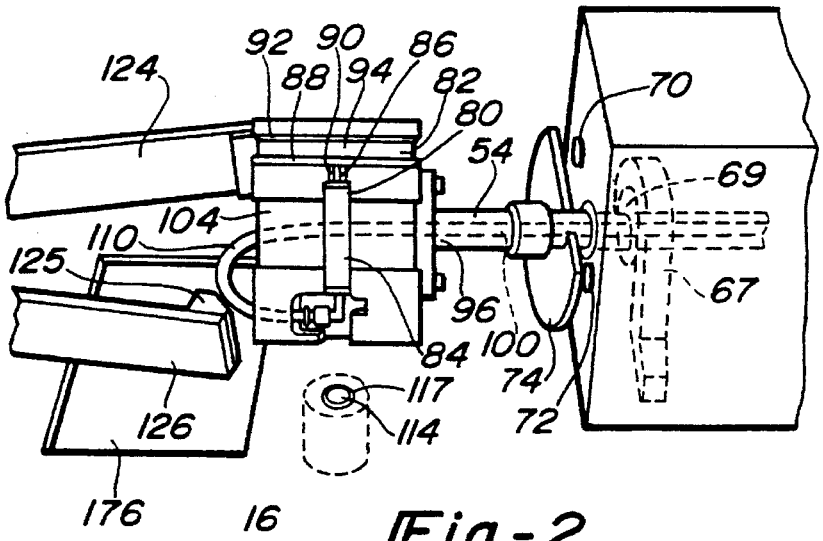
FIG. 2 is a fragmentary, perspective view of the rotating mandrel assembly in accordance with the present invention.

Referring now to FIGS. 1 and 2, there is shown the apparatus for manufacturing corrugated pallet spacers of the present invention, the apparatus generally indicated at 10. The apparatus 10 includes a base 12, a rotating mandrel assembly shown generally at 14, a punch 16, stripper 18 and a spacer accumulator 19. A plurality of one-piece blanks 20, is shown located in a loading station 22. A completed pallet spacer block 11 is shown in FIG. 12 operatively disposed between two pallet blanks 13 to form a completed cardboard pallet generally indicated at 15.

Figure 10:
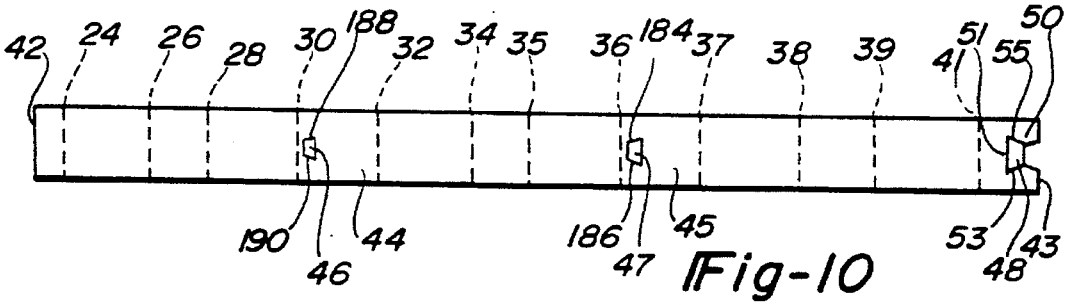
FIG. 10 is a front view of an alternative embodiment of a spacer blank made in accordance with the present invention.

As shown in FIG. 10, the preferred one-piece blank 20 has a plurality of score lines 24, 26, 28, 30, 32, 34, 35, 36, 37, 38, 39 and 41 disposed between a first end 42 and a second end 43. The one-piece blank has a inner wall 15 and an outer wall 17. The preferred one-piece blank is manufactured from conventional corrugated cardboard such as 200 pound, double weight, but any known foldable, material is contemplated for use in accordance with the present invention. The one-piece blank 20 has a preferred length of 63.75 inches, from first end 42 to second end 43, a preferred width of 4.375 inches, and a preferred thickness of 0.25 inches. The preferred corrugated cardboard uses a "B" flute and a "C" flute corrugation, as known in the art.

Figure 8:
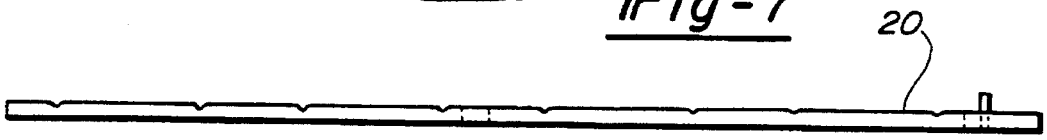
FIG. 8 is a side view of one embodiment of a spacer blank of the present invention.
Figure 9:
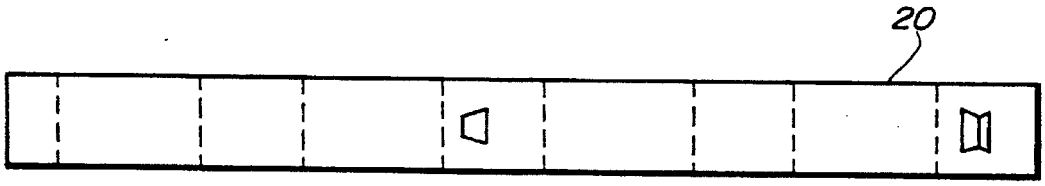
FIG. 9 is a front view of the spacer blank of FIG. 8 made in accordance with the present invention.

It is understood that the dimensions of the one-piece blank are adaptable to any length according to the size of the pallet spacer desired. FIGS. 8 and 9 illustrate an embodiment of the spacer blank 20 of the present invention which provides one less layer of cardboard forming the pallet spacer. The preferred one-piece blank 20, of FIG. 10 preferably includes a first retention segment 44 and a first retention aperture 46 located between score lines 30 and 32 and a second retention segment 45 and a second retention aperture 47. The second end 43 includes a cut-out flange 48 having a connected hinge 50. As can be seen from FIG. 9, the cut-out flange 48 is shaped to facilitate retention of the flange 48 in the apertures 46 and 47. The retention aperture is preferably trapezoidal shaped and the retention flange has a corresponding trapezoidal shape.

Figure 5:
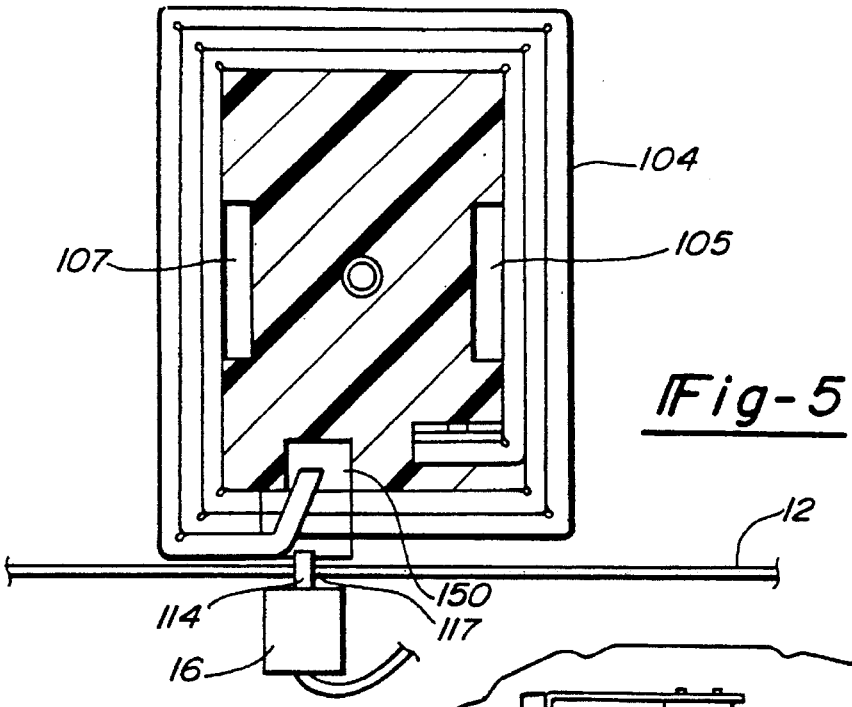
FIG. 5 is a fragmentary, partially cross sectioned view of the mandrel of the present invention, with the spacer blank completely wrapped about itself and the mandrel.

Specifically, flange 48 is connected at hinge 50, the opposite side 51 of flange 48 is disposed parallel to hinge 50. Flange 50 further includes a pair of symmetrical sides 53 and 55 extending from opposite side 51 and connected to hinge 50. In this configuration, the flange 48 is maintained in the apertures 46 and 47 upon entry as shown in FIG. 5. Flange sides 53 and 55 are retained against the aperture sides 188 and 190 of retention aperture 46 and aperture sides 184 and 186 of retention aperture 47.

Referring now to FIGS. 1 and 2, attention is now turned to the apparatus for forming a pallet spacer from the one-piece blank 20. Rotating mandrel assembly 14 includes a mandrel 52, a drive shaft 54 connected to the mandrel 52, and a drive motor 56 for driving the drive shaft 54 and mandrel 52. Drive motor 56 is, in the preferred embodiment, an air motor driven by a shop air supply (not shown). An electric motor for driving the drive shaft is also contemplated and within the scope of the invention. Drive motor 56 is operably connected to drive shaft 54 by a conventional sprocket and chain assembly 57.

Sprocket and chain assembly 57 includes a drive sprocket 58 connected on the output shaft 60 of the drive motor 56. A conventional link chain 62 connects the drive sprocket to the shaft sprocket 64 located on the drive shaft 54. A pair of bearing supports 66 and 68 rotatably support drive shaft 54. Each bearing support includes a bridge portion 67 and a rotating bearing portion 69. A guard housing 71 is shown in FIG. 1 completely encompassing the air motor 56, a portion of the drive shaft 54, and supports 66 and 68.

Still referring to FIGS. 1 and 2, there is shown a pair of conventional proximity sensors 70 and 72 located near the drive shaft 54. An activation collar 74 is affixed to the drive shaft such that is rotates in direct relation to the rotation of the drive shaft. In this manner in the preferred embodiment, the proximity sensors 70 and 72 sense the location of the activation collar as it passes near the sensors 70 and 72 and thereby provides an input signal corresponding to the location of the mandrel 52 within a given rotation cycle and also the amount of complete rotations of the mandrel.

Figure 3:
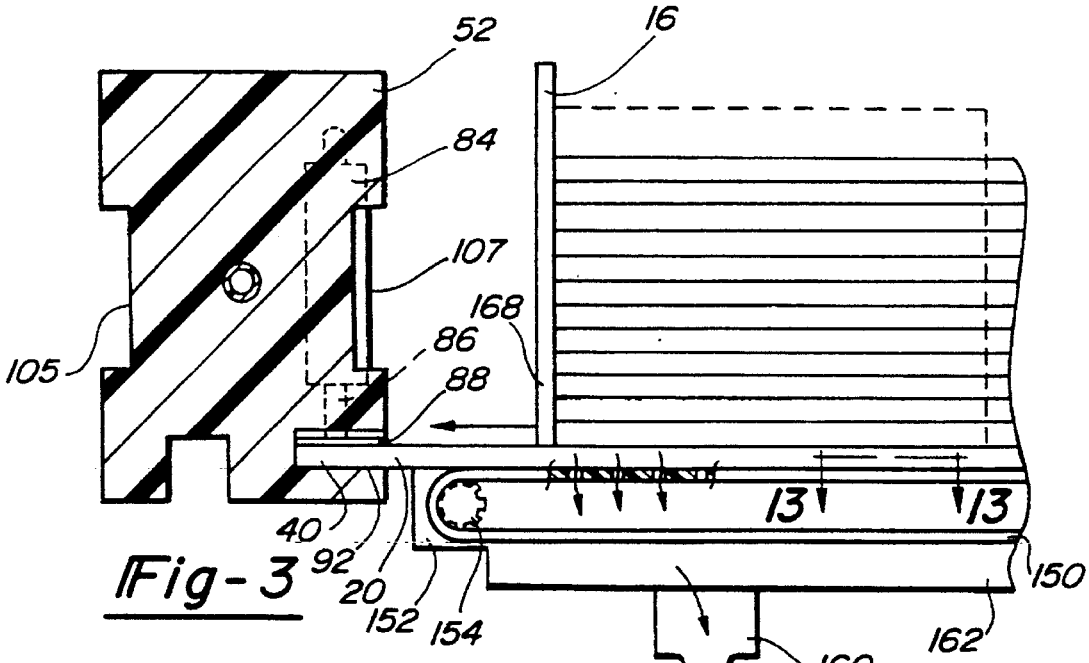
FIG. 3 is a fragmentary, partially cross sectioned view of the mandrel and loading station of the present invention, illustrating a one-piece spacer blank clamped into the mandrel.
Figure 4:
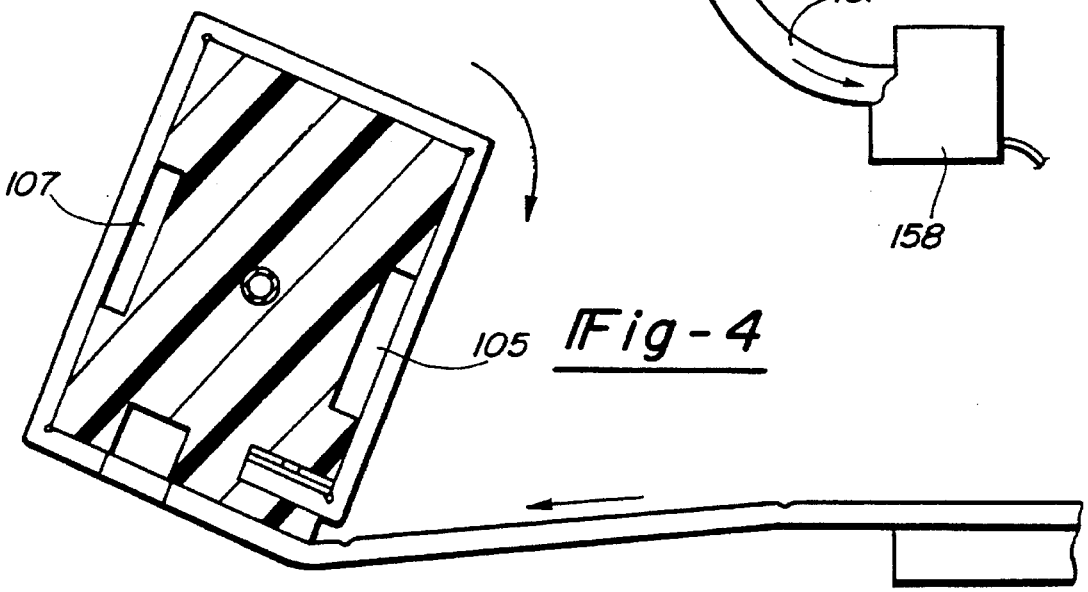
FIG. 4 is a fragmentary, partially cross sectioned view of the mandrel and loading of the present invention, illustrating the one-piece spacer blank partially wrapped on the mandrel shown in FIG. 3.

Referring now to FIGS. 2, 3 and 4, the mandrel 52 includes a cylinder cavity 80 and a clamping cavity 82. Cavity 80 is dimensioned to receive a regulated pneumatic cylinder 84 having an actuator shaft 86 and a clamping bar 88 affixed thereto. The clamping bar 88 is received within clamping cavity 82 and actuator shaft 86 is extendable between cavity 80 and cavity 82 through channel 90. The cavity 82 further includes an engagement surface 92 located directly opposite the opening 94 of the channel 90. In FIG. 2, the actuator shaft is in a retracted position, and in FIG. 3 the actuator shaft is shown in the extended position such that clamping bar 88 abuttingly engages and retains the first end 40 of the one-piece blank 20 against the engagement surface 92 during rotation of the mandrel 52.

The mandrel 52 also has a pair of extraction channels 105 and 107 located on opposite sides of the mandrel. The drive shaft 54 preferably includes a first end 96 and a second end 98 having a passageway 100 located therebetween for transmitting a fluid such as air. A fluid conduit 110 is connected in fluid communication with the drive shaft first end 96. The fluid conduit passes through passageway 104 in mandrel 52 as shown in FIG. 2.

The fluid conduit 110 is connected to the regulated cylinder 84 disposed in the mandrel 52. Thus regulated air for actuation of the regulated cylinder passes through the fluid conduit 110 to the regulated cylinder. Rotation of the mandrel 52 and the drive shaft 54 does not affect the supply of air to the regulated cylinder 84 or the actuation of clamping bar 88.

Referring to FIGS. 2 and 5, the punch 16 is shown disposed directly below the cut-out flange 48. Punch 16 is preferably a regulated cylinder having an extendable punch shaft 114. Punch 16 is preferably affixed to base 12 in a conventional manner such that punch shaft 114 is extendable up through aperture 117 defined within base 12.

Figure 6:
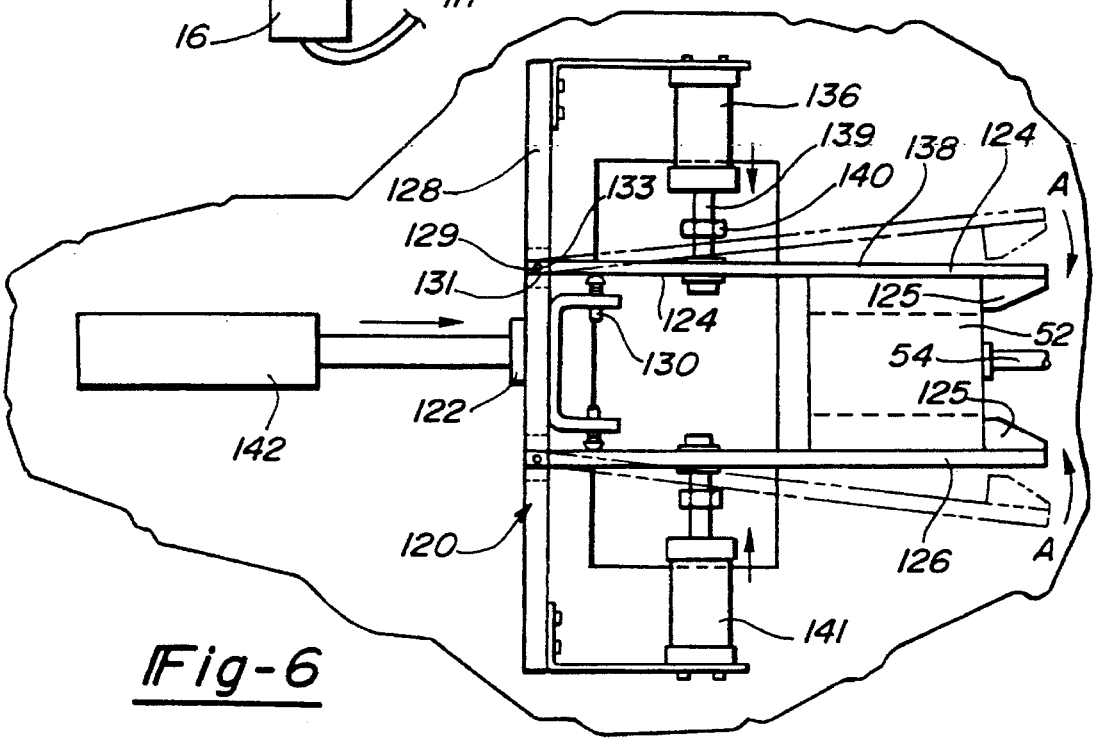
FIG. 6 is a top view of the stripper arm assembly of the present invention.
Figure 7:
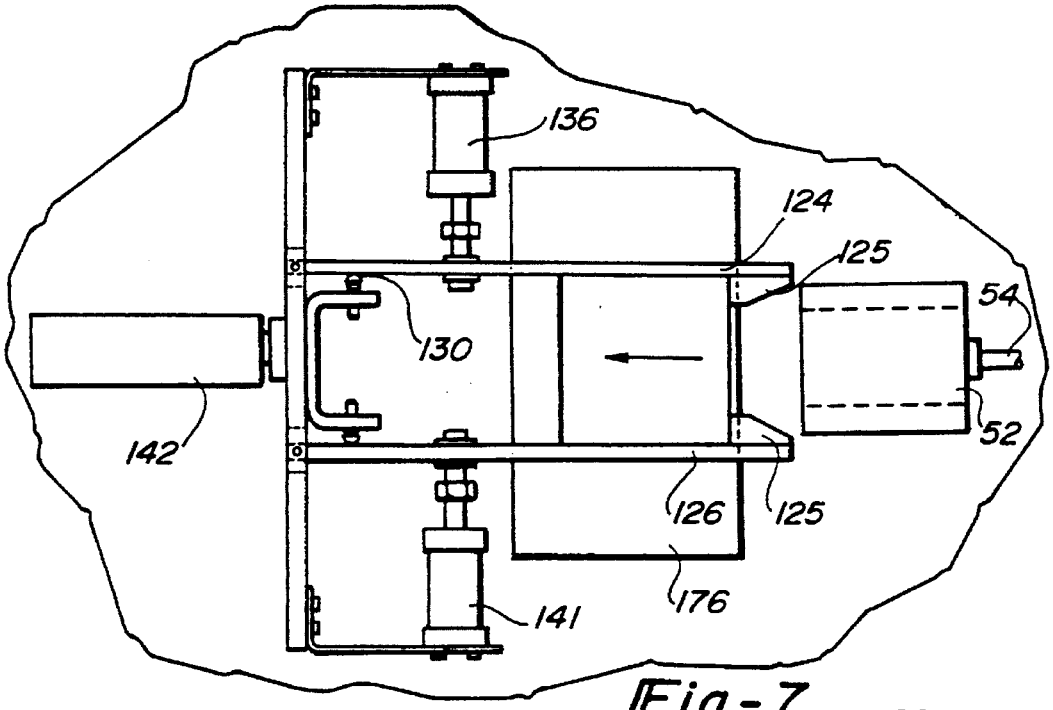
FIG. 7 is a top view of the stripper arm assembly of the present invention showing the arm assembly extracting the finished pallet spacer.

As shown in FIGS. 6 and 7, the present invention includes an stripper 120 shown generally at 120. The stripper 120 is comprised preferably of a horizontally retractable arm assembly 122. The horizontal arm assembly includes a pair of stripper arms 124 and 126. Each stripper arm includes a finger member 125. Stripper arms 124 and 126 are pivotally connected to a stanchion 128. The pivotal connection is preferably a pivot pin connection. A pivot pin 129 extends through a bore 131 on the stripper arms and also through a coaxially aligned bore 133 defined in the stanchion 128. In this manner, stripper arms are freely movable in a horizontal direction, as shown by the arrows (A) indicated in FIG. 6.

Referring now to the operation of stripper 124, a spring biasing member 130 is located on stanchion 128. Spring biasing member 130 is located on one side 134 of engagement arm 124. Spring biasing member 130 is configured to apply force to the engagement arm 124 such that the arm 124 is urged in a clockwise direction about pivot pin 129. A regulated cylinder 136 is affixed to the stanchion 128 or the base 12 and is further connected to the engagement arm 124 on opposite side 138.

The regulated cylinder 136 includes an actuator 139 having a positive stop 140. Actuation of cylinder 136 moves actuator 139 out from cylinder 136 which urges engagement arm 124 in a counter clockwise direction about pivot pin 129. In this manner, as can be seen in FIGS. 6 and 7, actuation of the cylinder 136 forces engagement arm 124 toward opposite engagement arm 126 overcoming the opposite force on engagement arm 124 created by spring biasing member 130. It is understood that the operation of the opposing engagement arm 126 is substantially identical to that described above except for the direction of the engagement arm 126. As is shown in FIG. 2, actuation of regulated cylinder 141 moves engagement arm 126 in a counterclockwise direction.

A larger regulated cylinder 142 is affixed to base 12. The regulated cylinder 142 is operably connected the stanchion 128 such that actuation of the regulated cylinder 142 moves the entire arm assembly 120, including the stanchion 128, from between a first position where the engagement arms are directly adjacent the mandrel, as shown on FIG. 6 to a second position where the engagement arms are positioned away from the mandrel, as shown in FIG. 7. More specifically, when the arm assembly is in the first position as shown in FIG. 2, and the regulated cylinders 136 and 141 are activated, the engagement arms will move from the free position (illustrated by the phantom lines) to the engagement position where the arms abuttingly engage the pallet spacer (illustrated by the solid lines). In the second position shown in FIG. 7, the pallet spacer is removed from the mandrel 52 and the arm assembly 120 is moved laterally away from the mandrel 52.

Referring now to FIG. 3, there is shown the loading station 22 of the present invention. In the preferred embodiment, the loading station utilizes a vacuum assisted drive belt 150. The vacuum assisted drive belt is driven by a conventional air motor 152 and drive system 154. The drive belt, as seen in FIG. 13 includes suction apertures 156. A vacuum generator 158 creates a vacuum pressure which is communicated from the generator 158, to a connection tube 161. The vacuum pressure is then communicated from the tube 161 to a collar 160 and finally to the belt drive housing 162. The preferred embodiment of the present invention uses a commercial blower operating in a reverse or vacuum mode.

In this manner, a vacuum or suction force is transferred from the generator 158, to the drive belt 150 and through the suction apertures 156. The individual blanks 20 are thus moved along the drive belt 150 toward the mandrel 52 by the movement of belt 150. The suction force temporarily affixes the blank 20 to the drive belt as long as the blank is disposed flat upon the belt 150. The blanks 20 are stacked in such a manner that only one blank may operatively contact the drive belt 150. A front stop 168 allows only one blank 20 to enter the mandrel at a time because the distance between the lower section 168 and the drive belt 150 is only slightly larger than the thickness of one blank 20.

As shown in FIGS. 1 and 14, the apparatus of the present invention preferably includes a pallet spacer accumulator 19. Accumulator 19 includes an accumulator housing 170, an accumulator support 172 and a pallet spacer ejector 174. The accumulator support is affixed below the base 12, directly below the exit aperture 176. After the stripper 120 removes the completed spacer 11 from the mandrel 52, the stripper moves laterally over the exit aperture 176. The completed spacer 11 falls through the aperture and down onto the accumulator support 172. The pallet spacer ejector 174 comprises a regulated cylinder 180 having a pair of actuator shafts 181 and 183. An elongated contact member 182 is affixed to the shafts 181 and 183 and operates to move the fallen spacer 11 laterally along the support 172 upon actuation of the cylinder 180. In this fashion, repeated dropping of completed spacers 11 through exit aperture 176 and subsequent indexing of the regulated cylinder 180 and contact member 182 moves each spacer along the accumulator support 172 as shown in FIG. 14. Any means for removing the spacers from the accumulator is contemplated and within the scope of the invention.

Having discussed the structural characteristics of the present invention, attention is now turned to the functional aspects of the present invention. As shown in FIGS. 1 and 3, the one-piece blank 20 is fed into the mandrel 52. The first end 40 is fed into the second cavity 82 of the mandrel 52. Actuation of biasing cylinder 84 moves clamping bar 88 against engagement surface 92 and clamping first end 40 against engagement surface 92.

Air motor 56 drives the sprocket assembly 60 which drives the drive shaft 54. Rotation of the drives shaft 54 rotates the mandrel 52 which has the one-piece blank clamped thereon. Upon rotation, the blank 20 is wrapped around the mandrel and drawn away from the loading station 22. Referring to FIG. 4, the one-piece blank is further wrapped about the mandrel 52. As the mandrel continues to rotate, the one-piece blank is reaches the position shown in FIG. 5.

The amount of rotation of the drive shaft is controlled by a conventional programmable controller 78, and at least one control valve 77. The programmable controller is electrically connected to the control valve 78 which is then connected by an air conduit 81 to the drive motor 56. As is known in the art, the programmable controller is programmed to receive the input signal from the proximity sensors 70 and 72 and to control the number of rotations the mandrel will complete to produce the desired pallet spacer. The number of revolutions of the mandrel is conveyed to the proximity sensors by the sensors ability to measure the presence or absence of the activation collar and the number of changes in this presence or absence. It is contemplated that pallet spacers 11 of varying thicknesses and shapes are achievable by varying the amount of revolutions of the mandrel. The programmable controller sends electrical control signals to the air motor which provides the means for rotation of the mandrel.

After the mandrel has made the predetermined number of revolutions, the punch 16 is activated and the extendable punch shaft 114 protrudes up through the exit aperture 117. The punch shaft 114 further protrudes up and contacts the cut-out flange 48, moving the flange through the retention aperture 46 and into a clearance channel 150 defined in the mandrel. At this point the pallet spacer 11 has been formed from the one-piece blank 20 and must be removed from the mandrel 52.

Referring to FIG. 6, the engagement arms 124 and 126, starting in the free position are moved adjacent the mandrel 52 and spacer 11 by moving the arm assembly 120 into the first position. The engagement arms are then moved into the engagement position. The arm assembly 120 is then moved into the second position as shown in FIG. 7. During this movement to the second position, the engaged arms stay closed relative to each other and the finger members 125 travel along the extraction channels 105 and 107 thereby moving the pallet spacer off the mandrel 52 and over the exit aperture 176. The engagement arms are then moved to the free position and the completed pallet spacer 11 falls down through the exit aperture 176.

While the best mode for carrying out the invention has been described in detail, those familiar with the art to which this invention relates will recognize alternative designs and embodiments for practicing the invention as defined by the following claims.

What is claimed is:

1. An apparatus for forming a pallet spacer from a one-piece blank, the one piece blank having at least a first end and a second opposite end and support segment disposed therebetween, the apparatus comprising;

a base;

a rotating mandrel mounted on said base for wrapping said one-piece blank around said mandrel forming a spiral shape, said rotating mandrel assembly including a selective engagement means for gripping said first end of said one-piece blank and wrapping said one-piece blank around said mandrel said support segment including a retention segment disposed between said first and second ends, said retention segment defining a retention aperture, said second end including a cut-out flange having a hinge, said rotating mandrel rotatable such that said retention aperture is registered directly adjacent said cutout flange;

a punch for pushing said cut-out flange into said retention aperture thereby retaining said one-piece blank in a coiled shape forming a pallet space; and an stripper for removing said pallet spacer from said rotating mandrel assembly.

2. An apparatus for forming a pallet spacer from a one-piece blank, the one piece blank having at least a first end and a second opposite end, a retention segment disposed between said first and second ends, said retention segment defining a retention aperture, said second end including a cut-out flange having a hinge, the apparatus comprising;

a base;

a rotating mandrel assembly mounted on said base for wrapping said one-piece blank around itself such that said retention aperture is registered directly adjacent said cut-out flange, said rotating mandrel assembly including a selective engagement means for gripping said first end of said one-piece blank when said one-piece blank is wrapped around itself;

a punch for pushing said cut-out flange into said retention aperture thereby retaining said one-piece blank in a coiled shape forming a pallet spacer; and stripper means for removing said pallet spacer from said rotating mandrel assembly.

3. An apparatus as in claim 2 wherein said punch is a regulated cylinder having an extendable punch shaft.

4. An apparatus as in claim 2 further comprising:

a loading station for transferring the one-piece spacer blank to said rotating mandrel, said loading station including a vacuum assisted belt drive.

5. An apparatus as in claim 2 wherein said rotating mandrel assembly comprises:

a mandrel;

a drive shaft affixed to said mandrel; and a drive means for rotating said drive shaft.

6. An apparatus as in claim 5 wherein said drive shaft includes a hollow passageway for providing a pressurized fluid to said rotating mandrel.

7. An apparatus as in claim 6 wherein said selective engagement means comprises a regulated pneumatic cylinder having an actuator shaft, said actuator shaft having a clamping bar affixed thereto, whereby said mandrel defines a first cavity adapted to receive said regulated pneumatic cylinder and a second cavity for receiving said clamping bar, said second cavity including an engagement surface so that actuation of said pneumatic cylinder extends said clamping bar towards said engagement surface to sufficiently grip the first end of the one-piece blank to retain the one-piece blank upon rotation of the mandrel.

8. An apparatus as in claim 7 wherein said drive means is an air motor.

9. An apparatus as in claim 7 wherein said drive means is an electric motor.

10. An apparatus as in claim 2 wherein said stripper comprises a horizontally retractable arm assembly movable between a first position and a second position, said arm assembly including an stripper and movable from a free position to an engagement position whereby movement of the arm assembly into the first position locates the engagement arm directly adjacent the mandrel and subsequent movement of the engagement arm into the engagement position locates the engagement arm in abutting engagement with the mandrel and wrapped pallet spacer.

11. An apparatus as in claim 10 wherein said arm assembly further comprises a stanchion, said engagement arm is pivotally connected to said stanchion, a spring biased member affixed to the stanchion, a second regulated cylinder having an actuator shaft affixed to said engagement arm adjacent said spring biasing member such that actuation of said actuator shaft in a first direction moves said engagement arm into the engagement position and actuation of said actuator shaft in a second direction moves said engagement arm into the free position.

12. An apparatus as in claim 11 wherein said arm assembly further includes a second, opposing, engagement arm movable from a free position to an engagement position whereby movement of the arm assembly into the first position locates the second engagement arm directly adjacent the mandrel, opposite said first engagement arm and subsequent movement of the second engagement arm into the engagement position locates the second engagement arm in abutting engagement with the mandrel and wrapped pallet spacer, directly opposite said first engagement arm.

13. An apparatus as in claim 12 wherein said stanchion is affixed to a third regulated cylinder adapted to selectively move said stanchion and said arm assembly in a horizontal direction from between said first position and said second position.

14. An apparatus for forming a pallet spacer from a one-piece blank, the one piece blank having at least a first end and a second opposite end, the apparatus comprising;

a base;

a rotating mandrel mounted on said base for wrapping said one-piece blank around said mandrel forming a spiral shape, said rotating mandrel assembly including an internally disposed clamp having an actuator which has an extended position in which the clamp positively grips said first end of said one-piece blank during wrapping of said one-piece blank around said mandrel; and a stripper for removing said pallet spacer from said rotating mandrel assembly after said internally disposed clamp is shifted by the actuator to a retracted position.

* * * * *